US009731322B2

(12) United States Patent
Tanaka et al.

(10) Patent No.: US 9,731,322 B2
(45) Date of Patent: Aug. 15, 2017

(54) PLATING APPARATUS, PLATING METHOD AND STORAGE MEDIUM HAVING PLATING PROGRAM STORED THEREON

(75) Inventors: Takashi Tanaka, Nirasaki (JP); Yusuke Saito, Nirasaki (JP); Mitsuaki Iwashita, Nirasaki (JP); Takayuki Toshima, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 945 days.

(21) Appl. No.: 13/881,431

(22) PCT Filed: Aug. 24, 2011

(86) PCT No.: PCT/JP2011/069010

§ 371 (c)(1),
(2), (4) Date: May 24, 2014

(87) PCT Pub. No.: WO2012/056801

PCT Pub. Date: May 3, 2012

(65) Prior Publication Data

US 2014/0302242 A1 Oct. 9, 2014

(30) Foreign Application Priority Data

Oct. 27, 2010 (JP) ..... 2010-240543

(51) Int. Cl.
*B05D 7/00* (2006.01)
*B05B 12/04* (2006.01)
(Continued)

(52) U.S. Cl.
CPC ..... *B05D 7/50* (2013.01); *B05B 12/04* (2013.01); *B05B 12/14* (2013.01); *B05D 1/02* (2013.01);
(Continued)

(58) Field of Classification Search
None
See application file for complete search history.

(56) References Cited

U.S. PATENT DOCUMENTS 5,605,488 A 2/1997 Ohashi et al.
2005/0074559 A1 4/2005 Inoue et al.
2005/0155865 A1* 7/2005 Mishima ..... C25D 17/02 205/170

FOREIGN PATENT DOCUMENTS

JP 07-122523 A 5/1995
JP 2000-064087 A 2/2000
(Continued)

OTHER PUBLICATIONS

Machine translation of JP 2000064087 A as published Feb. 2000; translation generated Mar. 2016.*
(Continued)

*Primary Examiner* — Michael P Rodriguez
(74) *Attorney, Agent, or Firm* — Pearne & Gordon LLP

(57) ABSTRACT

A plating apparatus 1 can perform plating processes by supplying plating liquids onto a surface of a substrate 2. The plating apparatus 1 includes a substrate rotating holder configured to hold and rotate the substrate 2; plating liquid supply units 29 and 30 configured to supply different kinds of plating liquids onto the surface of the substrate 2; a plating liquid drain unit 31 configured to drain out the plating liquids dispersed from the substrate 2 depending on the kinds of the plating liquids; and a controller 32 configured to control the substrate rotating holder 25, the plating liquid supply units 29 and 30, the plating liquid drain unit 31. While the substrate 2 is held and rotated, the plating processes are performed on the surface of the substrate 2 in sequence by supplying the different kinds of the plating liquids onto the surface of the substrate 2.

1 Claim, 8 Drawing Sheets

(51) Int. Cl.

| | |
|---|---|
| ***B05B 12/14*** | (2006.01) |
| ***B05D 1/02*** | (2006.01) |
| ***C25D 17/00*** | (2006.01) |
| ***C23C 18/16*** | (2006.01) |
| ***C23C 18/31*** | (2006.01) |
| ***C23C 18/54*** | (2006.01) |

(52) U.S. Cl.
CPC ..... *C23C 18/1632* (2013.01); *C23C 18/1651* (2013.01); *C23C 18/31* (2013.01); *C23C 18/54* (2013.01); *C25D 17/001* (2013.01)

(56) References Cited

FOREIGN PATENT DOCUMENTS

| | | | | |
|---|---|---|---|---|
| JP | 2000064087 | A | * | 2/2000 |
| JP | 2002-026491 | A | | 1/2002 |
| JP | 2002-038297 | A | | 2/2002 |
| JP | 2002-129344 | A | | 5/2002 |
| JP | 2003-124214 | A | | 4/2003 |
| JP | 2004-149824 | A | | 5/2004 |
| JP | 2004-200273 | A | | 7/2004 |
| JP | 2004-339579 | A | | 12/2004 |
| JP | 2005-029810 | A | | 2/2005 |

OTHER PUBLICATIONS

International Search Report for PCT/JP2011/069010 dated Oct. 4, 2011.

* cited by examiner

PLATING APPARATUS, PLATING METHOD AND STORAGE MEDIUM HAVING PLATING PROGRAM STORED THEREON

CROSS-REFERENCE TO RELATED APPLICATION

This Application is a U.S. national phase application under 35 U.S.C. §371 of PCT Application No. PCT/JP2011/069010 filed on Aug. 24, 2011, which claims the benefit of Japanese Patent Application No. 2010-240543 filed on Oct. 27, 2010, the entire disclosures of which are incorporated herein by reference.

TECHNICAL FIELD

The present disclosure relates to a plating apparatus and a plating method of performing a plating process by supplying a plating liquid on a surface of a substrate, and also relates to a storage medium having a plating program stored thereon.

BACKGROUND ART

Recently, wiring is formed on a substrate such as a semiconductor wafer or a liquid crystal substrate in order to form a circuit on a surface of the substrate. Copper wiring is widely used instead of aluminum wiring because copper has low electric resistance and high reliability. However, for example, since a surface of the copper wiring is easily oxidized and bonding strength of the copper wiring to solder is weak, palladium, nickel and gold are plated on the surface of the copper wiring in this sequence (see, for example, Japanese Patent Laid-open Publication No. 2005-029810).

Patent Document 1: Japanese Patent Laid-open Publication No. 2005-029810

Conventionally, to perform a multiple number of plating processes on the wiring of the substrate, a plating apparatus includes therein a palladium plating unit configured to perform a palladium plating process on the substrate, a nickel plating unit configured to perform a nickel plating process on the substrate, a gold plating unit configured to perform a gold plating process on the substrate, a cleaning unit configured to clean the substrate, a drying unit configured to dry the substrate and a transfer unit configured to transfer the substrate between the respective units. In this plating apparatus, the substrate is transferred into the respective units in this sequence by using the transfer unit, and the multiple number of plating processes are performed on the substrate.

Meanwhile, in the conventional plating apparatus, since the plating units configured to perform different kinds of plating processes are separately provided, the plating apparatus is scaled up.

Furthermore, in the conventional plating apparatus, since the plating processes are performed multiple times in the plating units while the transfer unit transfers the substrate into the respective plating units in sequence, processing time increases and throughput is reduced.

In accordance with one aspect of an illustrative embodiment, there is provided a plating apparatus of performing plating processes by supplying plating liquids onto a surface of a substrate. The plating apparatus includes a substrate rotating holder configured to hold and rotate the substrate; a multiple number of plating liquid supply units configured to supply different kinds of plating liquids onto the surface of the substrate held by the substrate rotating holder; a plating liquid drain unit disposed in a vicinity of the substrate rotating holder and configured to separate the plating liquids dispersed from the substrate depending on the kinds of the plating liquids and drain out the separated plating liquids; and a controller connected to the substrate rotating holder, the plating liquid supply units and the plating liquid drain unit and configured to control the substrate rotating holder, the plating liquid supply units and the plating liquid drain unit.

While the substrate is held and rotated by the substrate rotating holder, the controller may be configured to control the plating processes to be performed on the surface of the substrate in sequence by driving the plating liquid supply units in sequence.

The plating liquid drain unit may include a multiple number of drain openings vertically arranged in multi-levels; and an elevating device connected to the drain openings and configured to move the drain openings with respect to the substrate rotating holder.

The controller may be configured to control the elevating device such that the plating liquids supplied from the plating liquid supply units are drained out through different drain openings depending on the different kinds of plating liquids.

The plating apparatus may further include a cleaning liquid supply unit configured to supply a cleaning liquid onto the surface of the substrate; a rinse liquid supply unit configured to supply a rinse liquid onto the surface of the substrate; and a processing liquid drain unit configured to drain the cleaning liquid and the rinse liquid dispersed from the substrate.

A plating liquid collecting flow path through which a plating liquid to be reused flows, and a plating liquid waste flow path through which a plating liquid to be drained out flows may be connected to each of the drain openings of the plating liquid drain unit.

The controller may be configured to control the plating liquid drain unit such that the plating liquid from the drain opening is drained out through the plating liquid waste flow path if the plating liquid is mixed with a cleaning liquid or a rinse liquid.

The plating liquid supply units may include a displacement plating liquid supply unit configured to supply a plating liquid to perform a displacement plating and a chemical reduction plating liquid supply unit configured to supply a plating liquid to perform a chemical reduction plating, and the controller is configured to drive the chemical reduction plating liquid supply unit after driving the displacement plating liquid supply unit.

In accordance with another aspect of the illustrative embodiment, there is provided a plating apparatus of performing plating processes by supplying plating liquids onto a surface of a substrate. The plating apparatus includes a multi-plating unit configured to perform multiple kinds of plating processes on the surface of the substrate in sequence; a single-plating unit configured to perform a single kind of plating process on the surface of the substrate; a substrate transfer unit configured to transfer the substrate between the multi-plating unit and the single-plating unit; and a controller connected to the multi-plating unit, the single-plating unit and the substrate transfer unit and configured to control the multi-plating unit, the single-plating unit and the substrate transfer unit. The multi-plating unit includes a substrate rotating holder configured to hold and rotate the substrate; a multiple number of plating liquid supply units configured to supply different kinds of plating liquids onto the surface of the substrate held by the substrate rotating holder; and a plating liquid drain unit disposed in a vicinity of the substrate rotating holder and configured to separate the plating liquids dispersed from the substrate depending on the kinds of the plating liquids and drain out the separated plating liquids.

The controller may be configured to control the multi-plating unit, the single-plating unit and the substrate transfer unit such that after the multiple kinds of plating processes are performed on the surface of the substrate in sequence in the multi-plating unit, the substrate is transferred from the multi-plating unit into the single-plating unit by the substrate transfer device, and then, the single kind of plating process is performed on the surface of the substrate in the single-plating unit.

The number of the multi-plating unit may be larger than the number of the single-plating unit.

The controller may be configured to change a rotational speed of the substrate rotating holder depending on the kinds of the plating liquids supplied from the plating liquid supply units.

The controller may be configured to control the plating liquid supply unit such that an amount of the plating liquid supplied to a periphery of the substrate is greater than that of the plating liquid supplied to a central portion of the substrate.

The controller may be configured to control the plating liquid supply unit such that a temperature of the plating liquid supplied to a periphery of the substrate is higher than that of the plating liquid supplied to a central portion of the substrate.

The plating apparatus may further include a substrate temperature increasing device configured to increase a temperature of the substrate. The substrate temperature increasing device may increase the temperature of the substrate by bringing a bag-shaped member expanded by a high-temperature fluid into contact with a rear surface of the substrate.

The controller may be configured to change a heating temperature of the substrate temperature increasing device depending on the kinds of the plating liquids supplied from the plating liquid supply units.

In accordance with still another aspect of the illustrative embodiment, there is provided a plating method of performing plating processes by supplying plating liquids onto a surface of a substrate by using a plating apparatus. Here, the plating apparatus includes a substrate rotating holder configured to hold and rotate the substrate; a multiple number of plating liquid supply units configured to supply different kinds of plating liquids onto the surface of the substrate held by the substrate rotating holder; and a plating liquid drain unit disposed in a vicinity of the substrate rotating holder and configured to separate the plating liquids dispersed from the substrate depending on the kinds of the plating liquids and drain out the separated plating liquids. The plating method includes performing a plating process on the surface of the substrate by supplying a plating liquid onto the surface of the substrate from one of the plating liquid supply units; and performing a plating process on the surface of the substrate by supplying, from another one of the plating liquid supply units, a plating liquid different from the plating liquid supplied from the one plating liquid supply unit.

The plating liquid drain unit may include a multiple number of drain openings, and the plating liquid supplied from the one plating liquid supply unit and the plating liquid supplied from the another plating liquid supply unit are drained out through different drain openings of the plating liquid drain unit.

In accordance with still another aspect of the illustrative embodiment, there is provided a plating method of performing plating processes by supplying plating liquids onto a surface of a substrate by using a plating apparatus. The plating apparatus includes a multi-plating unit configured to perform multiple kinds of plating processes on the surface of the substrate in sequence; a single-plating unit configured to perform a single kind of plating process on the surface of the substrate; and a substrate transfer unit configured to transfer the substrate between the multi-plating unit and the single-plating unit. The plating method includes performing the multiple kinds of plating processes on the surface of the substrate in sequence by supplying different kinds of plating liquids onto the surface of the substrate in sequence in the multi-plating unit; transferring the substrate from the multi-plating unit into the single-plating unit by the substrate transfer unit; and performing the single kind of plating process by supplying a single kind of plating liquid onto the surface of the substrate in the single-plating unit.

In accordance with still another aspect of the illustrative embodiment, there is provided a computer-readable storage medium having stored thereon computer-executable instructions that, in response to execution, cause a plating apparatus to perform a plating method. The plating apparatus includes a substrate rotating holder configured to hold and rotate the substrate; a multiple number of plating liquid supply units configured to supply different kinds of plating liquids onto the surface of the substrate held by the substrate rotating holder; and a plating liquid drain unit disposed in a vicinity of the substrate rotating holder and configured to separate the plating liquids dispersed from the substrate depending on the kinds of the plating liquids and drain out the separated plating liquids. The plating method includes performing a plating process on the surface of the substrate by supplying a plating liquid onto the surface of the substrate from one of the plating liquid supply units; and performing a plating process on the surface of the substrate by supplying, from another one of the plating liquid supply units, a plating liquid different from the plating liquid supplied from the one plating liquid supply unit.

In accordance with the illustrative embodiments, there are provided a multiple number of plating liquid supply units that supply different kinds of plating liquids onto the surface of the substrate. With this configuration, since multiple kinds of plating processes can be performed in one plating apparatus, the plating apparatus can be miniaturized.

Further, in accordance with the illustrative embodiments, while holding and rotating the substrate, the different kinds of plating liquids are supplied onto the surface of the substrate in sequence, and the multiple kinds of plating processes are performed on the surface of the substrate in sequence. Accordingly, a processing time required for the plating processes can be reduced, so that throughput can be improved.

Furthermore, in accordance with the illustrative embodiments, by performing the multiple kinds of plating processes in sequence on the surface of the substrate, the surface of the substrate can be prevented from being oxidized. Accordingly, the plating processes can be performed on the surface of the substrate efficiently.

BEST MODE FOR CARRYING OUT THE INVENTION

Hereinafter, a plating apparatus, a plating method and a storage medium having a plating program stored thereon in accordance with an illustrative embodiment will be described with reference to the accompanying drawings.

Figure 1:
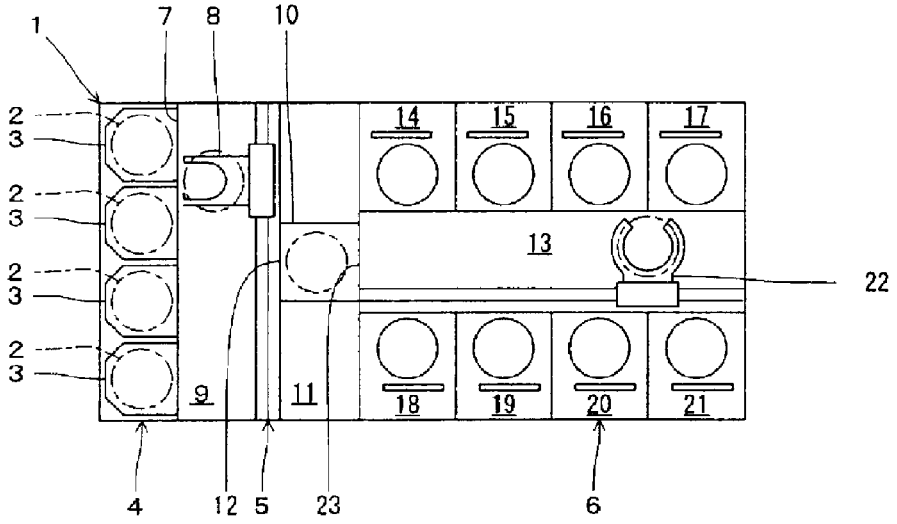
FIG. 1 is a plane view illustrating a plating apparatus in accordance with an illustrative embodiment.

As depicted in FIG. 1, the plating apparatus 1 includes a substrate loading/unloading table 4 disposed at a front end thereof; a substrate loading/unloading chamber 5 provided at the back of the substrate loading/unloading table 4; and a substrate processing chamber 6 provided at the back of the substrate loading/unloading chamber 5. The substrate loading/unloading table 4 is configured to load and unload thereon a carrier 3 accommodating a multiple number (e.g., 25 sheets) of substrates 2 (here, semiconductor wafers). The substrate loading/unloading chamber 5 is configured to load and unload sets of a certain number of the substrates 2 accommodated in the carrier 3. The substrate processing chamber 6 is configured to perform various processes such as a plating process and a cleaning process on the substrates 2.

The substrate loading/unloading table 4 is configured to mount thereon four carriers 3, and the carriers 3 are arranged to be firmly and closely contacted to a front wall of the substrate loading/unloading chamber 5 and spaced apart from each other by a certain distance.

A transfer chamber 9 including a transfer device 8 is provided at the front side of the substrate processing chamber 5, and a substrate delivery chamber 11 including a substrate delivery table 10 is provided at the rear side of the substrate processing chamber 5. The transfer chamber 9 and the substrate delivery chamber 11 communicate with each other through a delivery opening 12.

The substrate loading/unloading chamber 5 is configured to load and unload each set of the certain number of the substrates 2 by using the transfer device 8 between a carrier 3 mounted on the substrate loading/unloading table 4 and the substrate delivery table 10.

A substrate transfer unit 13 extended in the forward/backward direction is provided at a central portion of the substrate processing chamber 6. Four multi-plating units 14 to 17 are arranged at one side of the substrate transfer unit 13 in the forward/backward direction. The multi-plating units 14 to 17 are configured to perform different kinds of plating processes, respectively, in sequence. Further, two multi-plating units 18 and 19 and two single-plating units 20 and 21 are arranged at the other side of the substrate transfer unit 13 in the forward/backward direction. Here, each of the single-plating units 20 and 21 is configured to perform a single kind of plating process.

A substrate transfer device 22 configured to be moved in the forward/backward direction is accommodated in the substrate transfer unit 13. The substrate transfer unit 13 communicates with the substrate delivery table 10 of the substrate delivery chamber 11 through a substrate loading/unloading opening 23.

In the substrate processing chamber 6, the substrates 2 are transferred one by one between the substrate delivery chamber 11 and the multi-plating units 14 to 19, between the substrate delivery chamber 11 and the single-plating units 20 and 21 or between the multi-plating units 14 to 19 and the single-plating units 20 and 21 by the substrate transfer device 22 of the substrate transfer unit 13 while being held on the substrate transfer device 22 horizontally. Each of the plating units 14 to 21 is configured to perform a cleaning process and a plating process on the substrates 2 one by one.

The six multi-plating units 14 to 19 have the same configuration, and the two single-plating units 20 and 21 have the same configuration. Thus, in the following description, the configuration of the multi-plating unit 14 and the configuration of the single-plating unit 20 will only be explained.

Figure 2:
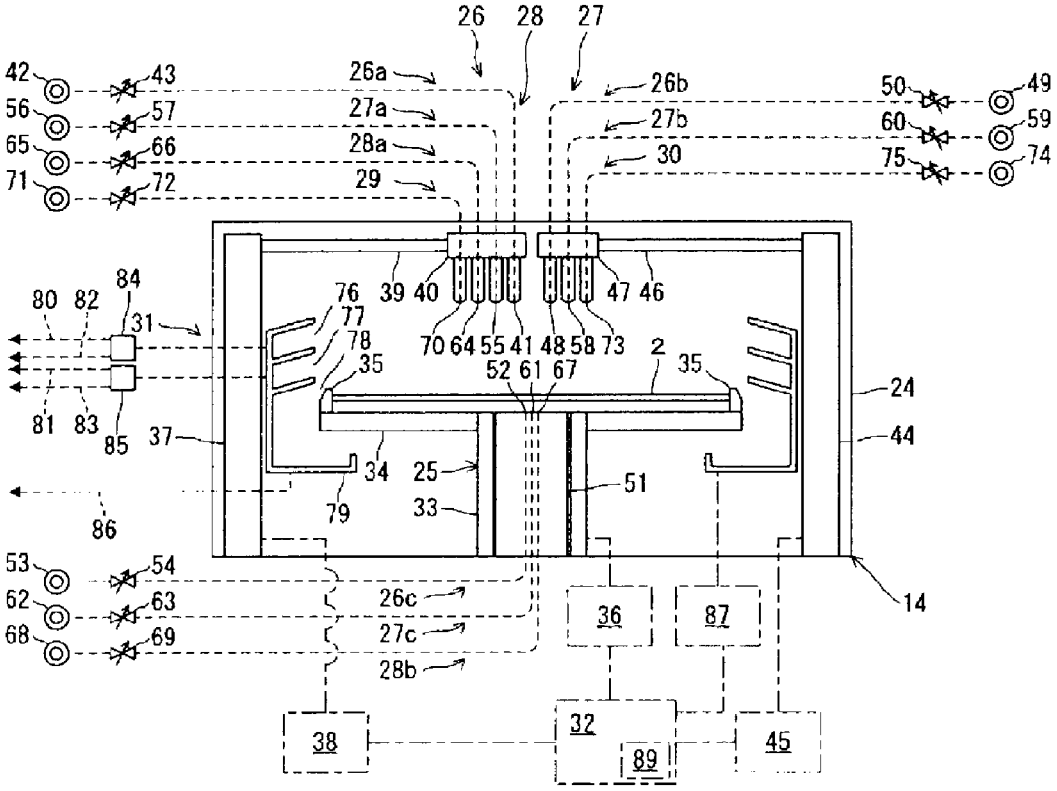
FIG. 2 is a side view illustrating a multi-plating unit of the plating apparatus in accordance with the illustrative embodiment.
Figure 3:
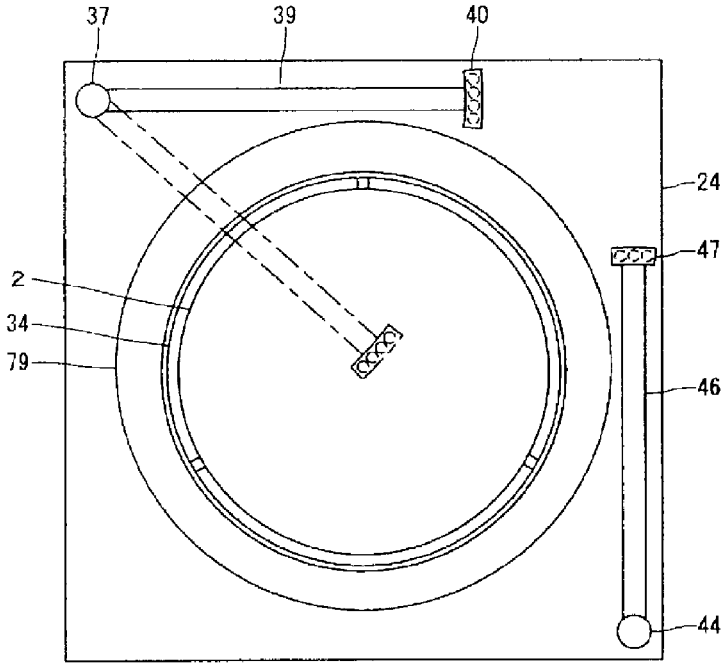
FIG. 3 is a plane view illustrating the multi-plating unit of the plating apparatus in accordance with the illustrative embodiment.

The multi-plating unit 14 includes, as illustrated in FIGS. 2 and 3, a casing 24, a substrate rotating holder 25, a cleaning liquid supply unit 26, a rinse liquid supply unit 27, a drying unit 28, a multiple number of plating liquid supply units (here, a displacement plating liquid supply unit 29 and a chemical reduction plating liquid supply unit 30), and a processing liquid drain unit 31 (plating liquid drain unit). The substrate rotating holder 25 is configured to rotate a substrate 2 while holding thereon the substrate horizontally within the casing 24. The cleaning liquid supply unit 26 supplies a cleaning liquid to the substrate 2. The rinse liquid supply unit 27 supplies a rinse liquid to the substrate 2. The drying unit 28 dries the substrate 2 by supplying a drying agent to the substrate 2. The displacement plating liquid supply unit 29 supplies a plating liquid used in performing a displacement plating on the substrate 2. The chemical reduction plating liquid supply unit 30 supplies a plating liquid used in performing a chemical reduction plating on the substrate 2. The processing liquid drain unit 31 drains the various kinds of processing liquids (cleaning liquid, rinse liquid, drying liquid and plating liquids) supplied onto the substrate 2. The substrate rotating holder 25, the cleaning liquid supply unit 26, the rinse liquid supply unit 27, the drying unit 28, the plating liquid supply units (the displacement plating liquid supply unit 29 and the chemical reduction plating liquid supply unit 30) and the processing liquid drain unit 31 are connected to a controller 32. Further, the controller 32 is connected to the multi-plating units 14 to 19, the single-plating units 20 and 21 and the substrate transfer unit 13. The controller 32 is configured to control the overall operation of the plating apparatus 1.

The substrate rotating holder 25 is rotatably provided at the casing 24. The substrate rotating holder 25 includes a hollow cylindrical rotation shaft 33 vertically extended within the casing 24; a turntable 34 horizontally provided at a top end portion of the rotation shaft 33; and wafer chucks 35 arranged on a periphery of a top surface of the turntable 34 at a regular distance along the circumference of the turntable 34.

Further, a rotating device 36 is connected to the rotation shaft 33 of the substrate rotating holder 25. The rotating device 36 is connected to the controller 32, and the operation of the rotating device 36 is controlled by the controller 32.

The rotation shaft 33 of the substrate rotating holder 25 is rotated by the rotating device 36. As the rotation shaft 33 is rotated, the substrate 2 horizontally held on the wafer chucks 35 is also rotated.

The cleaning liquid supply unit 26 includes first and second cleaning liquid supply units 26*a* and 26*b* configured to supply a cleaning liquid onto a top surface of the substrate 2; and a third cleaning liquid supply unit 26*c* configured to supply a cleaning liquid onto a rear surface of the substrate 2.

The first cleaning liquid supply unit 26*a* includes a vertically extended supporting shaft 37 that is rotatably provided at one side of the casing 24; a rotating device 38 such as a motor or an actuator connected to the supporting shaft 37; an arm 39 whose base end is horizontally fastened to a top end of the supporting shaft 37; a nozzle head 40 fastened to a leading end of the arm 39; and a nozzle 41 fastened to the nozzle head 40 to face downward (toward the top surface of the substrate 2). The nozzle 41 is connected via a flow rate control valve 43 to a cleaning liquid supply source 42 that supplies, as a processing liquid, a chemical liquid formed of inorganic acid such as hydrofluoric acid or organic acid such as malic acid. The rotating device 38 and the flow rate control valve 43 are connected to and controlled by the controller 32.

The second cleaning liquid supply unit 26*b* includes a vertically extended supporting shaft 44 that is rotatably provided at the other side of the casing 24; a rotating device 45 such as a motor or an actuator connected to the supporting shaft 44; an arm 46 whose base end is horizontally fastened to a top end of the supporting shaft 44; a nozzle head 47 fastened to a leading end of the arm 46; and a nozzle 48 fastened to the nozzle head 47 to face downward (toward the top surface of the substrate 2). The nozzle 48 is connected via a flow rate control valve 50 to a cleaning liquid supply source 49 (which may be the same as the cleaning liquid supply source 42) that supplies, as a processing liquid, a chemical liquid formed of inorganic acid such as hydrofluoric acid or organic acid such as malic acid. The rotating device 45 and the flow rate control valve 50 are connected to and controlled by the controller 32.

The third cleaning liquid supply unit 26*c* is fixed to the casing 24. The third cleaning liquid supply unit 26*c* includes a cylindrical shaft body 51; and a nozzle 52 formed at the shaft body 51. The shaft body 51 is accommodated in the hollow portion of the rotation shaft 33 of the substrate rotating holder 25 with a gap from the inner wall of the rotation shaft 33. The nozzle 52 is connected via a flow rate control valve 54 to a cleaning liquid supply source 53 (which may be the same as the cleaning liquid supply sources 42 and 49) that supplies, as a processing liquid, a chemical liquid formed of inorganic acid such as hydrofluoric acid or organic acid such as malic acid. The flow rate control valve 54 is connected to and controlled by the controller 32.

In the cleaning liquid supply unit 26(26*a*, 26*b*), the nozzle 41(48) is moved above the substrate 2 from a retreat position above an outside of the substrate 2 to a supply position above a central portion of the substrate 2 by rotating the supporting shaft 37(44) through the rotating device 38(45). Then, the cleaning liquid supply unit 26(26*a*, 26*b*) supplies a cleaning liquid toward the top surface of the substrate 2 from the nozzle 41(48) at a flow rate controlled by the flow rate control valve 43(50). Further, in the cleaning liquid supply unit 26(26*c*), a cleaning liquid is supplied toward a rear surface of the substrate 2 from the nozzle 52 at a flow rate controlled by the flow rate control valve 54. At this time, the cleaning liquid may be supplied toward above the central portion of the substrate 2 while locating the nozzle 41(48) at the position above the central portion of the substrate 2, or may be supplied toward the top surface of the substrate 2 while moving the nozzle 41(48) between a position above the central portion of the substrate 2 and a position above an outer peripheral end portion of the substrate 2.

The rinse liquid supply unit 27 includes first and second rinse liquid supply units 27*a* and 27*b* configured to supply a rinse liquid to the top surface of the substrate 2; and a third rinse liquid supply unit 27*c* configured to supply a rinse liquid to the rear surface of the substrate 2.

The first rinse liquid supply unit 27*a* shares the supporting shaft 37, the rotating device 38, the arm 39 and the nozzle head 40 with the first cleaning liquid supply unit 26*a*. The first rinse liquid supply unit 27*a* also includes a nozzle 55 provided at the nozzle head 40; and a rinse liquid supply source 56 that is connected to the nozzle 55 via a flow rate control valve 57 and supplies pure water as a rinse liquid. The flow rate control valve 57 is connected to and controlled by the controller 32.

The second rinse liquid supply unit 27*b* shares the supporting shaft 44, the rotating device 45, the arm 46 and the nozzle head 47 with the second cleaning liquid supply unit 26*b*. The second rinse liquid supply unit 27*b* also includes a nozzle 58 provided at the nozzle head 47; and a rinse liquid supply source 59 (which may be the same as the rinse liquid supply source 56) that is connected to the nozzle 58 via a flow rate control valve 60 and supplies pure water as a rinse liquid. The flow rate control valve 60 is connected to and controlled by the controller 32.

The third rinse liquid supply unit 27*c* shares the shaft body 51 with the third cleaning liquid supply unit 26*c*, and also includes a nozzle 61 formed at the shaft body 51 and a rinse liquid supply source 62 (which may be the same as the rinse liquid supply sources 56 and 59). The rinse liquid supply source 62 is connected to the nozzle 61 via a flow rate control valve 63 and supplies pure water as a rinse liquid. The flow rate control valve 63 is connected to and controlled by the controller 32.

In the rinse liquid supply unit 27(27*a*, 27*b*), by rotating the supporting shaft 37(44) through the rotating device 38(45), the nozzle 55(58) is moved above the substrate 2 from a retreat position above the outside of the substrate 2 to a supply position above the central portion of the substrate 2. Then, the rinse liquid supply unit 27 (27*a*, 27*b*) supplies a rinse liquid toward the substrate 2 from the nozzle 55(58) at a flow rate controlled by the flow rate control valve 57(60). Further, the rinse liquid supply unit 27(27*c*) supplies a rinse liquid toward the bottom surface of the substrate 2 from the nozzle 61 at a flow rate controlled by the flow rate control valve 63. At this time, the rinse liquid may be supplied toward above the central portion of the substrate 2 while maintaining the nozzle 55(58) at the position above the central portion of the substrate 2, or may be supplied to the top surface of the substrate 2 while moving the nozzle 55(58) between the position above the central portion of the substrate 2 and the position above the outer peripheral end portion of the substrate 2.

The drying unit 28 includes a first drying unit 28*a* configured to perform a drying process on the front surface of the substrate 2; and a second drying unit 28*b* configured to perform a drying process on the rear surface of the substrate 2.

The first drying unit 28*a* shares the supporting shaft 37, the rotating device 38, the arm 39 and the nozzle head 40 with the first cleaning liquid supply unit 26*a* and the first rinse liquid supply unit 27*a*. The first drying unit 28*a* also includes a nozzle 64 provided at the nozzle head 40; and a drying liquid supply source 65 that is connected to the nozzle 64 via a flow rate control valve 66 and supplies IPA (isopropyl alcohol) as a drying liquid. The flow rate control valve 66 is connected to and controlled by the controller 32.

The second drying unit 28*b* shares the shaft body 51 with the third cleaning liquid supply unit 26*c* and the third rinse liquid supply unit 27*c*. The second drying unit 28*b* also includes a nozzle 67 formed at the shaft body 51; and a drying agent supply source 68 that is connected to the nozzle 67 via a flow rate control valve 69 and supplies nitrogen as a drying agent. The flow rate control valve 69 is connected to and controlled by the controller 32.

In the drying unit 28(28*a*), by rotating the supporting shaft 37 through the rotating device 38, the nozzle 64 is moved above the substrate 2 from a retreat position above the outside of the substrate 2 to a supply position above a central portion of the substrate 2. Then, the drying unit 28(28*a*) supplies a drying liquid toward the top surface of the substrate 2 from the nozzle 64 at a flow rate controlled by the flow rate control valve 66. Further, the drying unit 28(28*b*) supplies a drying agent toward the bottom surface of the substrate 2 from the nozzle 67 at a flow rate controlled by the flow rate control valve 69. At this time, the drying liquid may be supplied toward above the central portion of the substrate 2 while maintaining the nozzle 64 at the position above the central portion of the substrate 2, or may be supplied to the top surface of the substrate 2 while moving the nozzle 64 between the position above the central portion of the substrate 2 and the position above the outer peripheral end portion of the substrate 2.

The displacement plating liquid supply unit 29 shares the supporting shaft 37, the rotating device 38, the arm 39 and the nozzle head 40 with the first cleaning liquid supply unit 26*a*, the first rinse liquid supply unit 27*a* and the first drying unit 28*a*. The displacement plating liquid supply unit 29 also includes a nozzle 70 provided at the nozzle head 40; and a displacement plating liquid supply source 71 that is connected to the nozzle 70 via a flow rate control valve 72 and supplies a plating liquid containing, but not limited to, palladium as a plating liquid to perform displacement plating. The flow rate control valve 72 is connected to and controlled by the controller 32. Further, the displacement plating liquid supply source 71 is configured to supply the displacement plating liquid at a preset temperature.

In the displacement plating liquid supply unit 29, by rotating the supporting shaft 37 through the rotating device 38, the nozzle 70 is moved above the substrate 2 from a retreat position above the outside of the substrate 2 to a supply position above the central portion of the substrate 2. Then, the displacement plating liquid supply unit 29 supplies the displacement plating liquid toward the top surface of the substrate 2 from the nozzle 70 at a flow rate controlled by the flow rate control valve 72. At this time, the displacement plating liquid may be supplied toward above the central portion of the substrate 2 while maintaining the nozzle 70 at the position above the central portion of the substrate 2, or may be supplied to the top surface of the substrate 2 while moving the nozzle 70 between the position above the central portion of the substrate 2 and the position above the outer peripheral end portion of the substrate 2.

The chemical reduction plating liquid supply unit 30 shares the supporting shaft 44, the rotating device 45, the arm 46 and the nozzle head 47 with the second cleaning liquid supply unit 26*b* and the second rinse liquid supply unit 27*b*. The chemical reduction plating liquid supply unit 30 also includes a nozzle 73 provided at the nozzle head 47; and a chemical reduction plating liquid supply source 74 that is connected to the nozzle 73 via a flow rate control valve 75 and supplies a plating liquid containing, but not limited to, nickel or cobalt as a plating liquid to perform chemical reduction plating. The flow rate control valve 75 is connected to and controlled by the controller 32. Further, the chemical reduction plating liquid supply source is configured to supply the chemical reduction plating liquid at a preset temperature.

In the chemical reduction plating liquid supply unit 30, by rotating the supporting shaft 44 through the rotating device 45, the nozzle 73 is moved above the substrate 2 from a retreat position above the outside of the substrate 2 to a supply position above the central portion of the substrate 2. Then, the chemical reduction plating liquid supply unit 30 supplies the chemical reduction plating liquid toward the top surface of the substrate 2 from the nozzle 73 at a flow rate controlled by the flow rate control valve 75. At this time, the chemical reduction plating liquid may be supplied toward above the central portion of the substrate 2 while maintaining the nozzle 73 at the position above the central portion of the substrate 2, or may be supplied to the top surface of the substrate 2 while moving the nozzle 73 between the position above the central portion of the substrate 2 and the position above the outer peripheral end portion of the substrate 2.

The processing liquid drain unit 31 is provided at an outside of the turntable 34. The processing liquid drain unit 31 includes a cup 79 having drain openings 76, 77 and vertically arranged in three levels to drain used processing liquids; collecting flow paths 80 and 81 connected to the topmost drain opening 76 and the intermediate drain opening 77 via flow path switching devices 84 and 85, respectively; waste flow paths 82 and 83 connected to the topmost drain opening 76 and the intermediate drain opening 77 via the flow path switching devices 84 and 85, respectively; and a waste flow path 86 connected to the bottommost drain opening 78. The flow path switching devices 84 and 85 are connected to and controlled by the controller 32. Here, the collecting flow paths 80 and 81 are flow paths through which the used processing liquids are collected to be reused, and the waste flow paths 82, 83 and 86 are flow paths through which the used processing liquids are drained out.

The processing liquid drain unit 31 also includes an elevating device 87 connected to the cup 79. The elevating device 87 is connected to and controlled by the controller 32. The elevating device 87 is configured to move the cup up and down with respect to the substrate 2. Alternatively, the elevating device 87 may be provided at the substrate rotating holder 25 and configured to move the substrate 2 up and down.

In the processing liquid drain unit 31, by moving the cup 79 up and down through the elevating device 87, one of the drain openings 76, 77 and 78 is located at a position directly outside the substrate 2, and a processing liquid dispersed from the substrate 2 is received by the one of the drain openings 76, 77 and 78. By using different drain openings 76 to 78, processing liquids dispersed from the substrate 2 can be received while being separated from each other. Further, in the processing liquid drain unit 31, by switching the flow paths to the collecting flow paths 80 and by the flow path switching devices 84 and 85, the processing liquids collected from the drain openings 76 and 77 can be reused. Meanwhile, by switching the flow paths to the waste flow paths 82 and 83 by the flow path switching devices 84 and 85, the processing liquids collected from the drain openings 76, 77 and 78 can be drained out.

Figure 4:
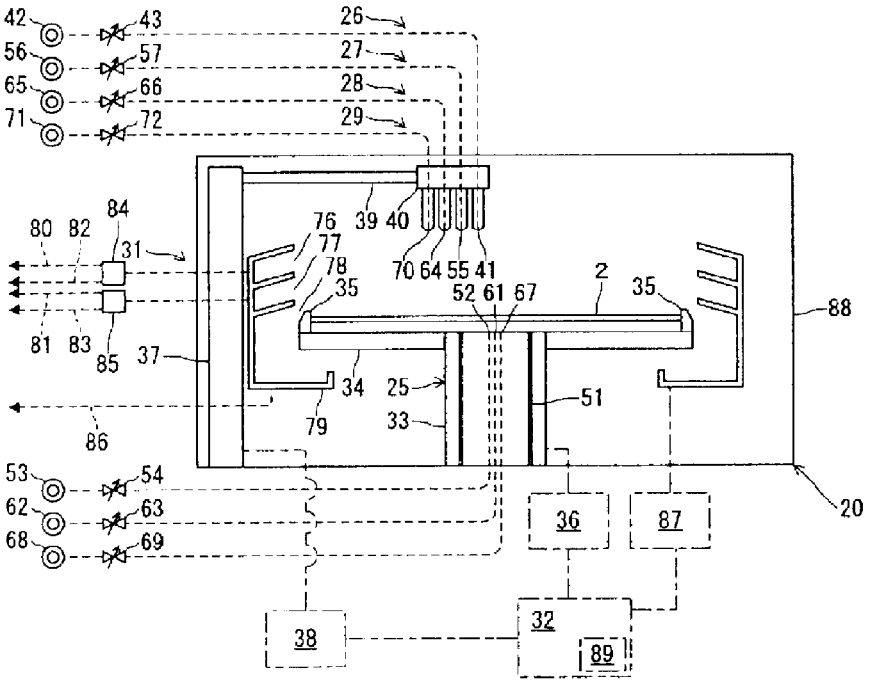
FIG. 4 is a side view illustrating a single-plating unit of the plating apparatus in accordance with the illustrative embodiment.

Like the multi-plating unit 14, the single-plating unit 20 also includes the substrate rotating holder 25; a cleaning liquid supply unit 26 (first and third cleaning liquid supply units 26*a* and 26*c*); a rinse liquid supply unit (first and third rinse liquid supply units 27*a* and 27*c*); a drying unit 28 (first and second drying units 28*a* and 28*b*); a single plating liquid supply unit (displacement plating liquid supply unit 29); and a processing liquid drain unit 31, as shown in FIG. 4. The substrate rotating holder 25, the cleaning liquid supply unit 26, the rinse liquid supply unit 27, the drying unit 28, the plating liquid supply unit and the processing liquid drain unit 31 are accommodated in a casing 88. Further, the substrate rotating holder 25, the cleaning liquid supply unit 26, the rinse liquid supply unit 27, the drying unit 28, the displacement plating liquid supply unit 29 and the processing liquid drain unit 31 are connected to the controller 32.

In the single-plating unit 20 in accordance with the present illustrative embodiment, only the displacement plating liquid supply unit 29 is provided as a plating liquid supply unit, and a chemical reduction plating liquid supply unit 30 is not provided.

By way of non-limiting example, in the single-plating unit 20, a plating liquid containing gold is used as the plating liquid supplied from the displacement plating liquid supply unit 29 to perform the displacement plating process.

As described above, the plating apparatus 1 includes the multi-plating units 14 to 19; the single-plating units 20 and 21; and the substrate transfer unit 13 that transfers substrates 2 between the multi-plating units 14 to 19 and the single-plating units 20 and 21. Each of the multi-plating units 14 to 19 includes, in the casing 24, the substrate rotating holder 25, the multiple number of the plating liquid supply units (here, the displacement plating liquid supply unit 29 and the chemical reduction plating liquid supply unit 30) and the plating liquid drain unit (processing liquid drain unit 31) that are configured to perform multiple kinds of plating processes on the surface of a substrate 2 in sequence. Each of the single-plating units 20 and 21 includes, in the casing 88, the substrate rotating holder 25, the single plating liquid supply unit (here, the displacement plating liquid supply unit 29) and the plating liquid drain unit (processing liquid drain unit 31) that are configured to perform a single kind of plating process on the surface of the substrate 2.

With this configuration, it may be possible to use at least one of the multi-plating units 14 to 19 and the single-plating units 20 and 21 depending on the kind of a plating process to be performed on the substrate 2.

Further, in the above-described plating apparatus 1, the number (here, four six) of the multi-plating units 14 to 19 is larger than the number (here, two) of the single-plating units 20 and 21. Thus, the multi-plating units 14 to 19 having a long processing time and the single-plating units 20 and 21 having a short processing time can be operated efficiently, so that throughput of the plating apparatus 1 can be improved.

In addition, in the above-described plating apparatus 1, gold plating is performed only in the single-plating units 20 and 21 without being performed in the multi-plating units 14 to 19. Accordingly, efficiency in repair and maintenance of the multi-plating units 14 to 19 can be improved. Further, for example, after both palladium plating and nickel (or cobalt) plating are performed or only the palladium plating is performed in the multi-plating units 14 to 19, gold plating may be performed on the surface of palladium or nickel (or cobalt) in the single-plating units 20 and 21. Thus, it may be possible to use the multi-plating units 14 to 19 and the single-plating units 20 and separately depending on the types of the plating processes that are performed therein. Especially, in the above-described plating apparatus 1, by performing a plating process using an acidic plating liquid containing nickel, palladium or the like in the multi-plating units 14 to 19 while performing a plating process using an alkaline plating liquid containing gold or the like in the single-plating units 20 and 21, the processes performed in different atmospheres cannot be mixed.

The plating apparatus 1 having the above-described configuration is operated and controlled by the controller 32 based on various types of programs stored on the storage medium 89 of the controller 32 to perform a required process on a substrate 2. Here, the storage medium 89 stores therein various types of setup data or programs such as a plating program to be described below. The storage medium 89 may be implemented by a computer-readable memory such as a ROM or a RAM, or a disk-shaped storage medium such as a hard disk, a CD-ROM, a DVD-ROM or a flexible disk.

Figure 5:
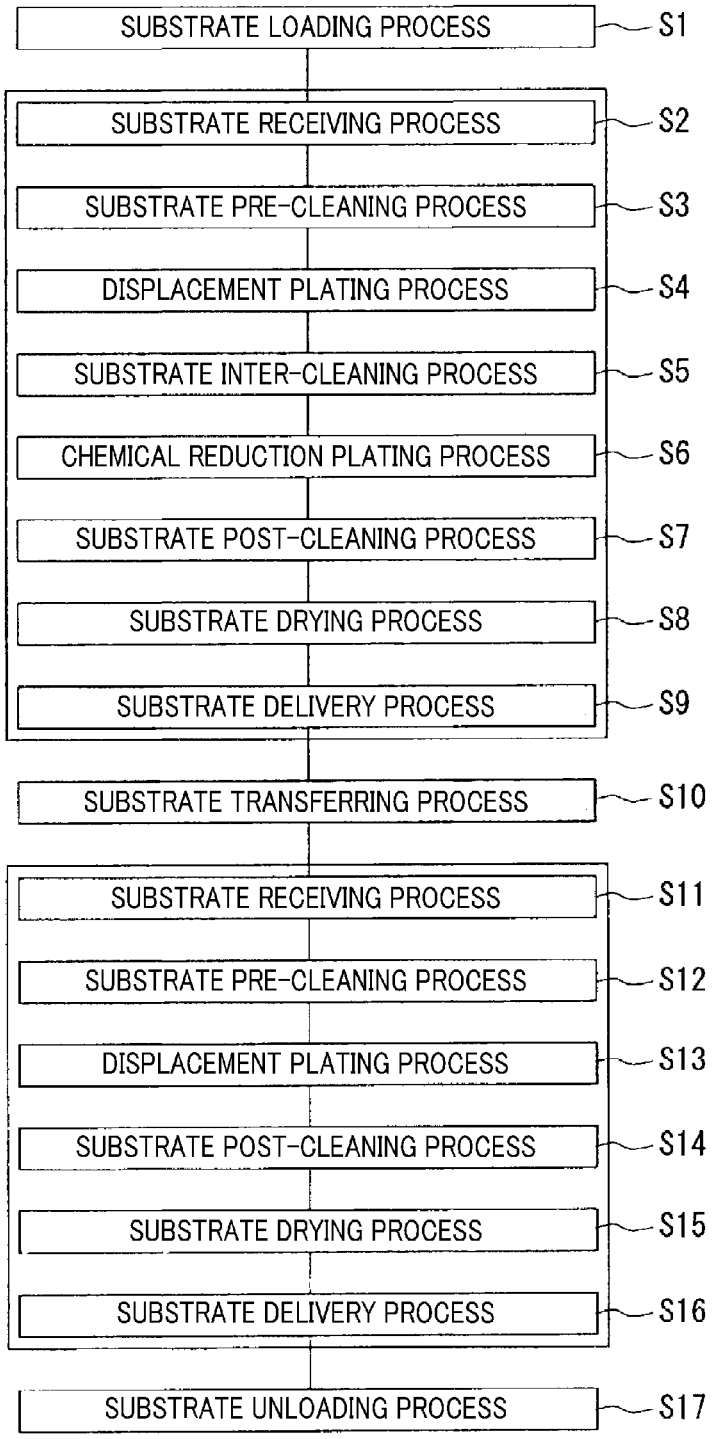
FIG. 5 is a process diagram for describing a plating method in accordance with the illustrative embodiment.

In the plating apparatus 1, a plating process is performed on the substrate 2 according to a plating program stored on the storage medium 89 of the controller 32, as will be described below (see FIG. 5). In the following description, for example, palladium is plated on the substrate 2 by the displacement plating, and then, nickel plating is performed by the chemical reduction plating in the multi-plating unit 14. Thereafter, gold is plated on the substrate 2 by the displacement plating in the single-plating unit 20.

First, according to the plating program, a substrate loading process S1 is performed.

In this substrate loading process S1, a single sheet of substrate 2 is loaded into the multi-plating unit 14 by the substrate transfer device 22 of the substrate transfer unit 13 from the substrate delivery chamber 11.

At this time, according to the plating program, a substrate receiving process S2 is performed in the multi-plating unit 14.

Figure 6:
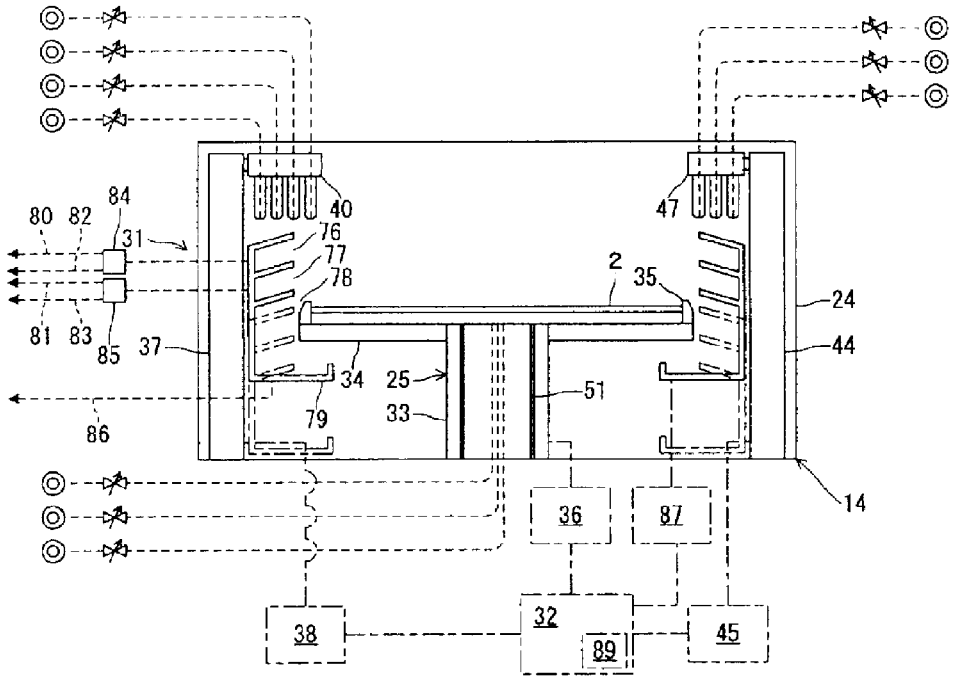
FIG. 6 is a diagram for describing operations of the plating method in accordance with the illustrative embodiment.

In the substrate receiving process S2, the cup 79 is moved down to a preset position by the elevating device 87, as illustrated in FIG. 6. Then, the single sheet of the substrate 2 loaded into the casing 24 by the substrate transfer device 22 is received on the wafer chucks 35 while being held horizontally. Thereafter, the cup 79 is moved up by the elevating device 87 to a position where the bottommost drain opening 78 faces an outer peripheral end portion of the substrate 2. At this time, according to the plating program, the supporting shafts 37 and 44 are rotated by the rotating devices 38 and 45, respectively, so that the nozzle heads 40 and 47 are located at retreat positions outside the periphery of the turntable 34, respectively.

Subsequently, according to the plating program, a substrate pre-cleaning process S3 is performed in the multi-plating unit 14.

Figure 7:
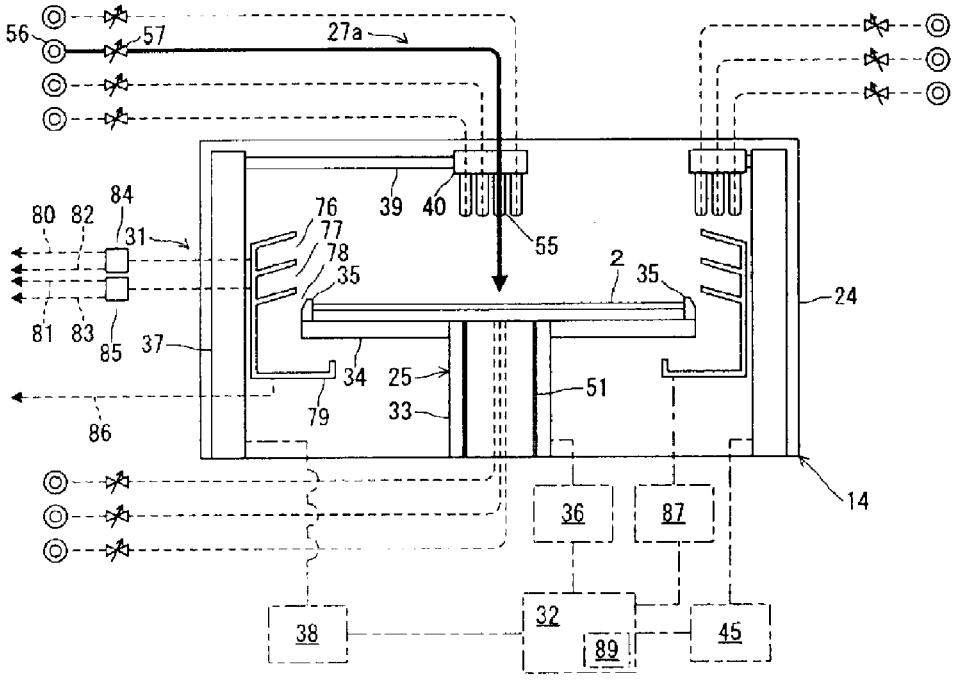
FIG. 7 is a diagram for describing operations of the plating method in accordance with the illustrative embodiment.

In the substrate pre-cleaning process S3, as illustrated in FIG. 7, by rotating the rotation shaft 33 through the rotating device 36 of the substrate rotating holder 25, the turntable 34 and the substrate 2 are rotated together. Further, by rotating the supporting shaft 37 through the rotating device 38 of the first rinse liquid supply unit 27*a*, the nozzle 55 is moved to a supply position above the central portion of the substrate 2. Thereafter, a rinse liquid is supplied toward the top surface of the substrate 2 from the nozzle 55 at a preset flow rate controlled by the flow rate control valve 57 of the first rinse liquid supply unit 27*a*. Then, a rinse process is performed on the top surface of the substrate 2. The used rinse liquid is collected through the bottommost drain opening 78 of the cup 79 of the processing liquid drain unit and drained out through the waste flow path 86. Thereafter, the supply of the rinse liquid by the first rinse liquid supply unit 27*a* is stopped.

Figure 8:
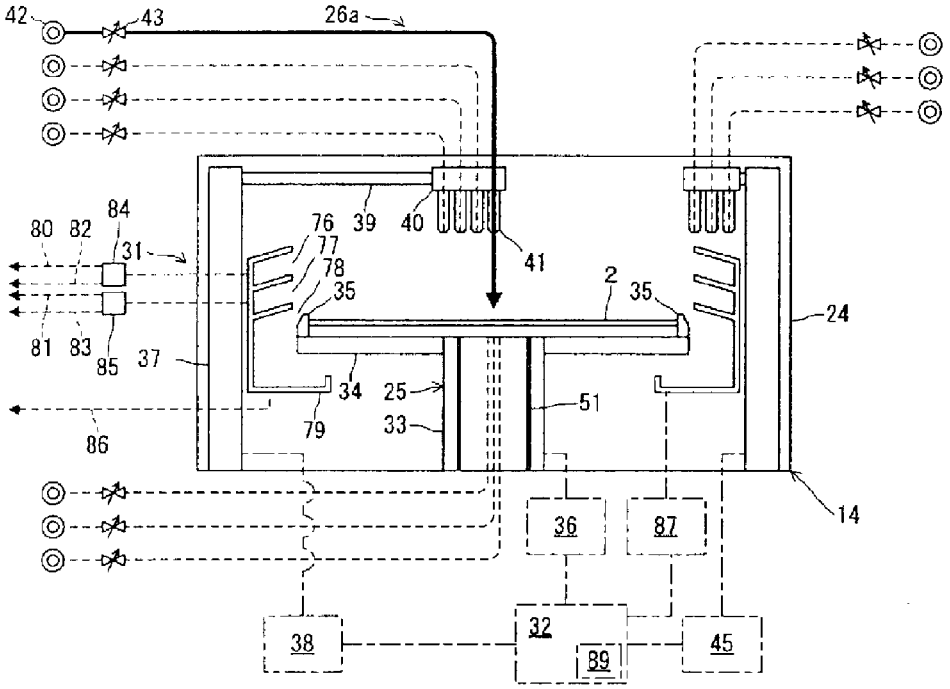
FIG. 8 is a diagram for describing operations of the plating method in accordance with the illustrative embodiment.

Afterward, in the substrate pre-cleaning process S3, as illustrated in FIG. 8, by rotating the supporting shaft through the rotating device 38 of the first cleaning liquid supply unit 26*a*, the nozzle 41 is moved to the supply position above the central portion of the substrate 2. Then, a cleaning liquid is supplied toward the top surface of the substrate 2 from the nozzle 41 at a preset flow rate controlled by the flow rate control valve 43 of the first cleaning liquid supply unit 26*a*. Then, a cleaning process is performed on the top surface of the substrate 2. The used cleaning liquid is collected through the bottommost drain opening 78 of the cup 79 of the processing liquid drain unit 31 and drained out through the waste flow path 86. Thereafter, the supply of the cleaning liquid by the first cleaning liquid supply unit 26*a* is stopped. Further, it may be also possible to clean the outer peripheral end portion of the substrate 2 as well as the top surface thereof by the cleaning liquid.

Thereafter, in the substrate pre-cleaning process S3, a rinse process is performed on the top surface of the substrate 2 in the same manner as the rinse process which is performed before the cleaning process (see FIG. 7).

Subsequently, according to the plating program, in the multi-plating unit 14, a displacement plating process S4 is performed on the substrate 2 which is not yet dried immediately after the rinse process in the substrate pre-cleaning process S3. By performing the displacement plating process S4 on the substrate 2 which is not dried, it is possible to prevent copper or the like on a target surface of the substrate 2 from being oxidized, so that the displacement plating process S4 can be efficiently performed.

Figure 9:
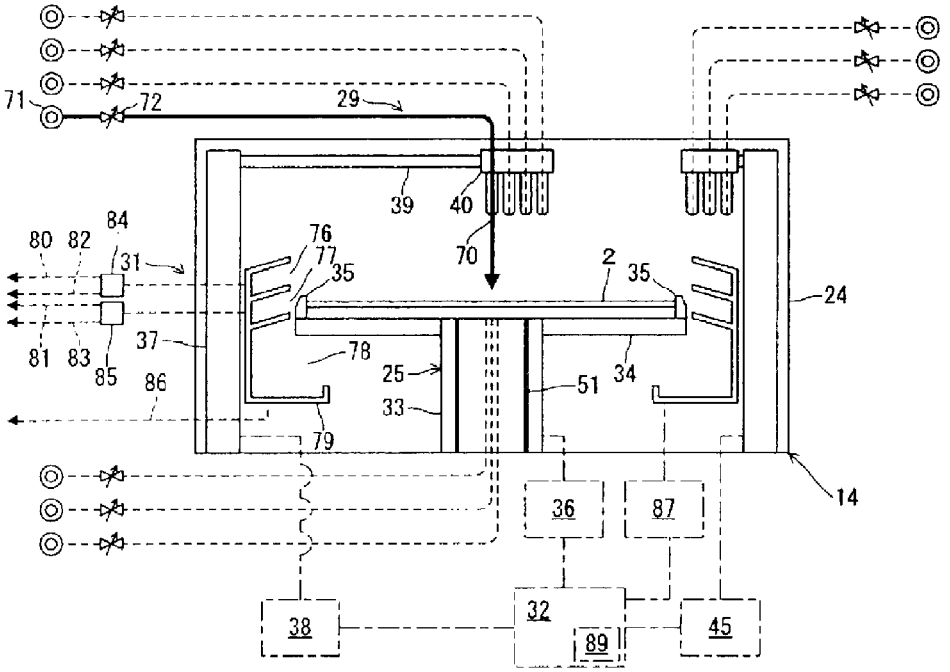
FIG. 9 is a diagram for describing operations of the plating method in accordance with the illustrative embodiment.

In the displacement plating process S4, as illustrated in FIG. 9, while rotating the substrate 2 through the rotating device 36 of the substrate rotating holder 25, the cup 79 is moved down by the elevating device of the processing liquid drain unit 31 to a position where the intermediate drain opening 77 faces the outer peripheral end portion of the substrate 2. Further, by rotating the supporting shaft 37 through the rotating device of the displacement plating liquid supply unit 29, the nozzle 70 is moved to the supply position above the central portion of the substrate 2. Thereafter, a displacement plating liquid having a room temperature and containing palladium is supplied toward the top surface of the substrate 2 from the nozzle 70 at a preset flow rate controlled by the flow rate control valve 72 of the displacement plating liquid supply unit 29. Accordingly, palladium is plated on the top surface of the substrate 2 by the displacement plating. Then, the used displacement plating liquid is collected through the intermediate drain opening 77 of the cup 79 of the processing liquid drain unit 31. Then, by switching the flow path switching device 85, the displacement plating liquid may be drained out through the waste flow path 83 if the displacement plating liquid is mixed with the rinse liquid or the cleaning liquid, or the displacement plating liquid may be collected through the collecting flow path 81 to be reused if the displacement plating liquid is not mixed with the rinse liquid or the cleaning liquid. Then, the supply of the displacement plating liquid by the displacement plating liquid supply unit 29 is stopped. Here, the flow path switching device 85 may be configured to switch flow paths with a certain time lapse or may be configured to switch the flow paths after detecting presence or absence of the rinse liquid by a sensor.

In this displacement plating process S4, by setting a moving speed of the nozzle 70 of the displacement plating liquid supply unit 29 at the outer periphery of the substrate 2 to be lower than a moving speed at an inner periphery of the substrate 2, by setting a discharge amount of the plating liquid at the outer periphery of the substrate 2 to be larger than a discharge amount of the plating liquid at the inner periphery of the substrate 2, or by setting a temperature of the discharged plating liquid at the outer periphery of the substrate 2 to be higher than a temperature of the discharged plating liquid at the inner periphery of the substrate 2, the temperature of the substrate 2 can be controlled to be uniform.

Thereafter, in the displacement plating process S4, a rinse process is performed on the top surface of the substrate 2 in the same manner as the rinse process performed in the substrate pre-cleaning process S3 (see FIG. 7).

Subsequently, according to the plating program, a substrate inter-cleaning process S5 is performed in the multi-plating unit 14. This substrate inter-cleaning process S5 may be omitted.

In the substrate inter-cleaning process S5, the top surface of the substrate is rinsed by the first rinse liquid supply unit 27*a*, and a bottom surface of the substrate is cleaned by the third cleaning liquid supply unit 26*c*. Thereafter, the bottom surface of the substrate is rinsed by the third rinse liquid supply unit 27*c*. Then, by rotating the supporting shaft 37 of the rotating device 38, the nozzle head 40 is moved to the retreat position outside the outer periphery of the turntable 34.

Then, according to the plating program, following the rinse process in the substrate inter-cleaning process S5 (or in the displacement plating process S4 if the substrate inter-cleaning process S5 is omitted), a chemical reduction plating process S6 is performed in the multi-plating unit 14. In this way, since the displacement plating process S4 and the chemical reduction plating process S6 can be performed within the single unit, i.e., in the multi-plating unit 14, the substrate 2 does not need to be transferred to perform the displacement plating process S4 and the chemical reduction plating process S6 and, further, a drying process of the substrate 2 can be omitted. Accordingly, throughput can be improved. Further, since the surface of the substrate 2 can be prevented from being oxidized, a plating process can be performed efficiently on the surface of the substrate 2.

Figure 10:
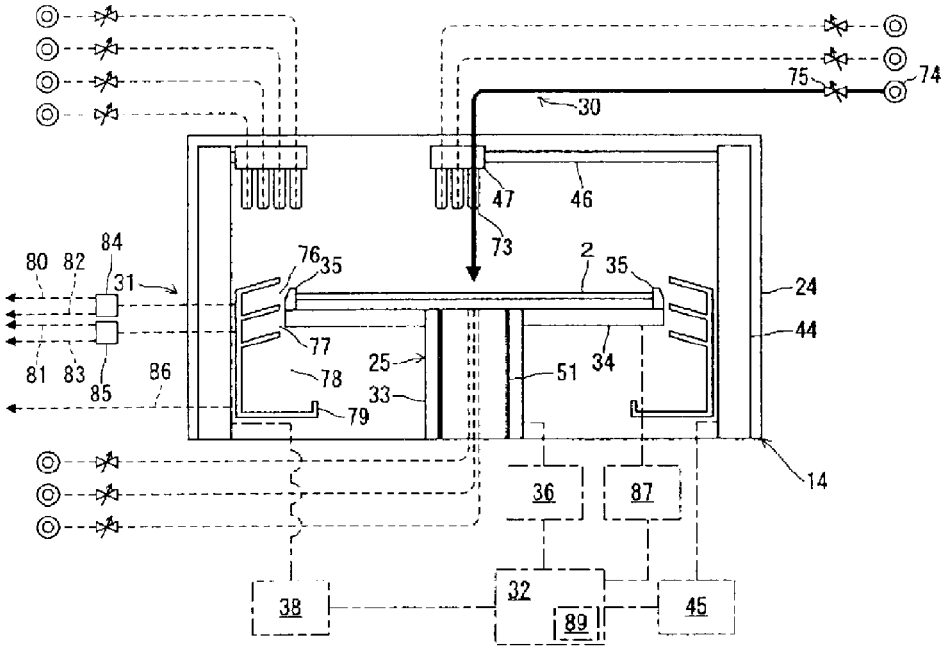
FIG. 10 is a diagram for describing operations of the plating method in accordance with the illustrative embodiment.

In the chemical reduction plating process S6, as illustrated in FIG. 10, the turntable 34 is rotated by the rotating device 36 of the substrate rotating holder 25 at a rotational speed lower than a rotational speed in the displacement plating process S4, so that the substrate 2 is rotated at a low speed. Further, the cup 79 is moved down to a position where the topmost drain opening 76 faces the outer peripheral end portion of the substrate 2 by the elevating device 87 of the processing liquid drain unit 31. Further, by rotating the supporting shaft 44 through the rotating device 45 of the chemical reduction plating liquid supply unit 30, the nozzle 73 is moved to the supply position above the central portion of the substrate 2. Then, a chemical reduction plating liquid containing nickel of a high temperature ranging, e.g., from about 80° C. to about 85° C. is supplied toward the top surface of the substrate 2 from the nozzle 73 at a preset flow rate controlled by the flow rate control valve 75 of the chemical reduction plating liquid supply unit 30. Then, nickel plating is performed on the top surface of the substrate 2 by the chemical reduction plating. The used chemical reduction plating liquid is collected through the topmost drain opening 76 of the cup 79 of the processing liquid drain unit 31. Then, by switching the flow path switching device 84, the chemical reduction plating liquid may be drained out through the waste flow path 82 if the displacement plating liquid is mixed with the rinse liquid or the cleaning liquid, or the chemical reduction plating liquid may be collected through the collecting flow path 80 to be reused if the chemical reduction plating liquid is not mixed with the rinse liquid or the cleaning liquid. Thereafter, the supply of the chemical reduction plating liquid by the chemical reduction plating liquid supply unit 30 is stopped. Here, the flow path switching device 84 may be configured to switch flow paths with the time lapse or may be configured to switch the flow paths after detecting presence or absence of the rinse liquid by a sensor.

In the chemical reduction plating process S6, the substrate 2 is rotated at the speed lower than the rotational speed of the substrate 2 in the displacement plating process S4. In this way, by changing the rotational speed of the substrate 2 rotated by the substrate rotating holder 25 depending on the kinds (temperatures) of the plating liquids supplied from the plating liquid supply units (the displacement plating liquid supply unit 29 and the chemical reduction plating liquid supply unit 30), the substrate 2 or the plating liquids can be prevented from being cooled through the thermal radiation by rotating the substrate 2. Especially, when using a high-temperature plating liquid, by setting the rotational speed of the substrate 2 to be low, a temperature decrease of the plating liquid can be suppressed. As a result, the substrate 2 may be plated uniformly in a required thickness.

Further, in the chemical reduction plating process S6, the chemical reduction plating liquid is drained through the drain opening 76 of the cup 79 which is different from the drain opening 77 that is used in the displacement plating process S4. By draining the plating liquids through the different drain openings 76 and 77 depending on the kinds of the plating liquids, the plating liquids can be prevented from being mixed with each other.

In this chemical reduction plating process S6, by setting a moving speed of the nozzle 73 of the chemical reduction plating liquid supply unit 30 at the outer periphery of the substrate 2 to be lower than a moving speed at the inner periphery of the substrate 2, by setting a discharge amount of the plating liquid at the outer periphery of the substrate 2 to be larger than a discharge amount of the plating liquid at the inner periphery of the substrate 2, or by setting a temperature of the discharged plating liquid at the outer periphery of the substrate 2 to be higher than a temperature of the discharged plating liquid at the inner periphery of the substrate 2, the temperature of the substrate 2 can be controlled to be uniform.

Figure 11:
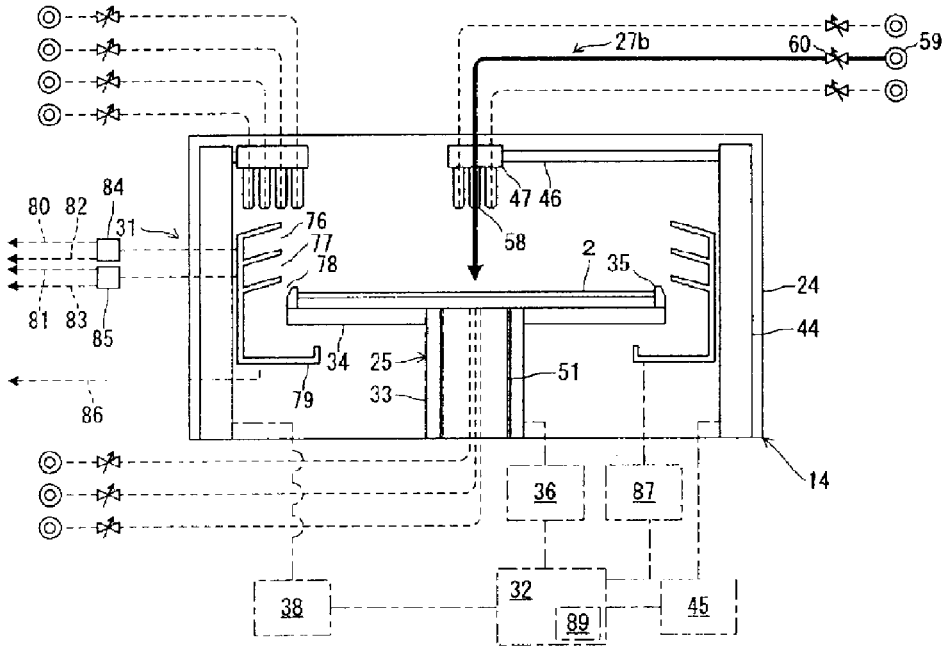
FIG. 11 is a diagram for describing operations of the plating method in accordance with the illustrative embodiment.

Thereafter, in the chemical reduction plating process S6, as illustrated in FIG. 11, the cup 79 is moved up by the elevating device 87 of the processing liquid drain unit 31 to a position where the bottommost drain opening 78 faces the outer peripheral end portion of the substrate 2. Further, by rotating the supporting shaft 44 through the rotating device 45 of the second rinse liquid supply unit 27*b*, the nozzle 58 is moved to the supply position above the central portion of the substrate 2. Then, a rinse liquid is supplied toward the top surface of the substrate 2 from the nozzle 58 at a preset flow rate controlled by the flow rate control valve 60 of the second rinse liquid supply unit 27*b*. Then, the rinse process is performed on the top surface of the substrate 2. The used rinse liquid is collected through the bottommost drain opening 78 of the cup 79 of the processing liquid drain unit 31 and is drained out through the waste flow path 86. Thereafter, the supply of the rinse liquid by the second rinse liquid supply unit 27*b* is stopped.

Subsequently, according to the plating program, a substrate post-cleaning process S7 is performed in the multi-plating unit 14.

Figure 12:
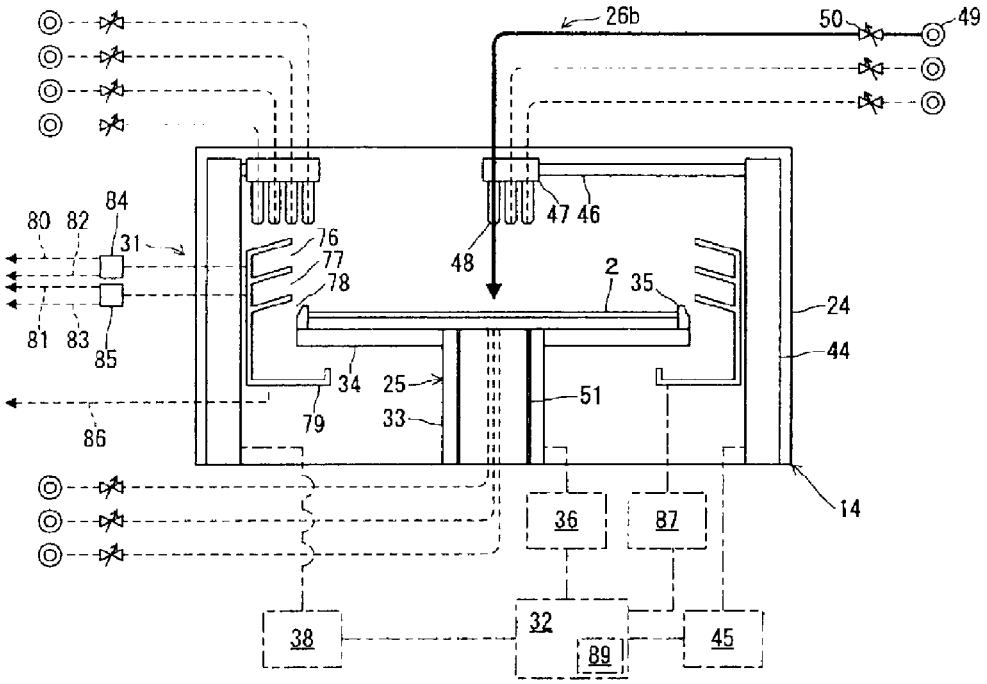
FIG. 12 is a diagram for describing operations of the plating method in accordance with the illustrative embodiment.

In the substrate post-cleaning process S7, as illustrated in FIG. 12, by rotating the supporting shaft 44 through the rotating device 45 of the second cleaning liquid supply unit 26*b*, the nozzle 48 is moved to the supply position above the central portion of the substrate 2. Then, a cleaning liquid is supplied toward the top surface of the substrate 2 from the nozzle 48 at a preset flow rate controlled by the flow rate control valve 50 of the second cleaning liquid supply unit 26*b*. As a result, the top surface of the substrate 2 is cleaned. After the cleaning process, the used cleaning liquid is collected through the bottommost opening 78 of the cup 79 of the processing liquid drain unit 31, and then, is drained out through the waste flow path 86. Thereafter, the supply of the cleaning liquid by the second cleaning liquid supply unit 26*b* is stopped. Here, it may be also possible to clean the outer peripheral end portion of the substrate 2 as well as the top and bottom surfaces of the substrate 2 by the cleaning liquid. Further, it may be also possible to use a cleaning liquid different from the cleaning liquid used in the substrate pre-cleaning process S3.

Afterward, in the substrate post-cleaning process S7, the top surface of the substrate is rinsed by the first rinse liquid supply unit 27*a*, and after the bottom surface of the substrate is cleaned by the third cleaning liquid supply unit 26*c*, the bottom surface of the substrate is rinsed by the third rinse liquid supply unit 27*c*. Then, by rotating the supporting shaft 44 through the rotating device 45, the nozzle head 47 is moved to the retreat position outside the outer periphery of the substrate 2.

Subsequently, according to the plating program, a substrate drying process S8 is performed in the multi-plating unit 14.

Figure 13:
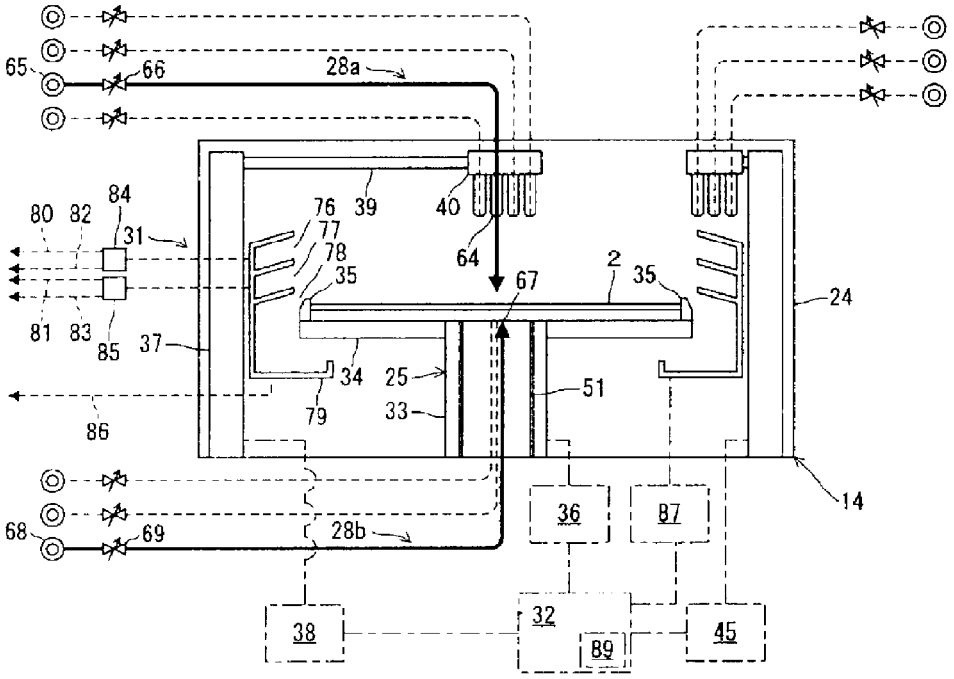
FIG. 13 is a diagram for describing operations of the plating method in accordance with the illustrative embodiment.

In the substrate drying process S8, as illustrated in FIG. 13, by rotating the supporting shaft 37 through the rotating device 38 of the first drying unit 28*a*, the nozzle 64 is moved to the supply position above the central portion of the substrate 2. Then, a drying liquid is supplied toward the top surface of the substrate 2 from the nozzle 64 at a preset flow rate controlled by the flow rate control valve 66. Further, a drying agent of a preset flow rate controlled by the flow rate control valve 69 of the second drying unit 28*b* is supplied toward the bottom surface of the substrate from the nozzle 67. As a result, the top and bottom surfaces of the substrate 2 are dried. After the drying processes, the used drying liquid is collected through the bottommost drain opening 78 of the cup 79 of the processing liquid drain unit 31 and is drained out through the waste flow path 86. Thereafter, the drying processes by the first and second drying units 28*a* and 28*b* are stopped, and by rotating the supporting shaft 37 through the rotating device 38, the nozzle head 40 is moved to the retreat position outside the outer periphery of the substrate 2.

Now, according to the plating program, a substrate delivery process S9 is performed.

Figure 14:
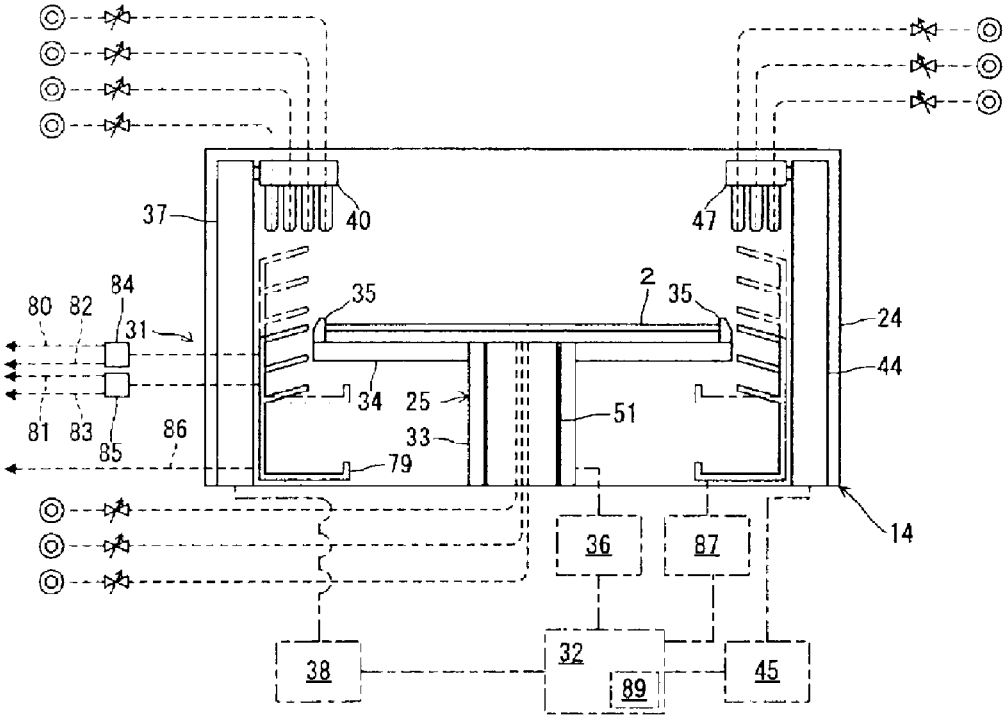
FIG. 14 is a diagram for describing operations of the plating method in accordance with the illustrative embodiment.

In the substrate delivery process S9, as illustrated in FIG. 14, the cup 79 is moved down to a certain position by the elevating device 87, and the substrate 2 horizontally held on the substrate rotating holder 25 is delivered onto the substrate transfer device 22.

Then, according to the plating program, a substrate transferring process S10 is performed.

In the substrate transferring process S10, the single sheet of the substrate 2 is transferred from the multi-plating unit 14 to the single-plating unit 20 through the substrate transfer device 22 of the substrate transfer unit 13.

Thereafter, according to the plating program, like the respective processes S2 to S4 and S7 to S9 in the multi-plating unit 14, a substrate receiving process S11, a substrate pre-cleaning process S12, a displacement plating process S13, a substrate post-cleaning process S14, a substrate drying process S15 and a substrate delivery process S16 are performed in sequence in the single-plating unit 20.

In the single-plating unit 20, liquid as a displacement plating process S13, gold is plated on the substrate 2 by the displacement plating with a gold-containing plating liquid.

At this time, as in the chemical reduction plating process S6 in the multi-plating unit 14, while rotating the substrate 2 at a rotational speed lower than a rotational speed of the substrate 2 in the displacement plating process S4 in the multi-plating unit 14, the gold-containing displacement plating liquid having a high temperature ranging, e.g., from about 80° C. to about 85° C. is supplied from the displacement plating liquid supply source 71. Further, in the single-plating unit 20, the displacement plating liquid mixed with a rinse liquid is also collected.

Finally, according to the plating program, a substrate unloading process S17 is performed.

In the substrate unloading process S17, the single sheet of the substrate 2 is unloaded from the single-plating unit 20 into the substrate delivery chamber 11 by using the substrate transfer device 22 of the substrate transfer unit 13.

As discussed above, the plating apparatus 1 includes the multiple number of plating liquid supply units (here, the displacement plating liquid supply unit 29 and the chemical reduction plating liquid supply unit 30) configured to supply different kinds of plating liquids (here, the palladium-containing displacement plating liquid and the nickel-containing chemical reduction plating liquid) onto the surface of the substrate 2. With this configuration, the size of the plating apparatus 1 can be reduced. Further, while rotating and holding the substrate 2, the plating apparatus 1 is configured to perform the multiple kinds of plating processes on the surface of the substrate 2 in sequence by supplying the different kinds of plating liquids onto the surface of the substrate 2 in order. Accordingly, the time required for transferring or drying the substrate 2 can be reduced, and, thus, the time required for the plating process can also be shortened. As a result, throughput of the plating apparatus 1 can be improved. Further, by performing the multiple kinds of plating processes on the surface of the substrate 2 in sequence, the surface of the substrate 2 can be prevented from being oxidized, so that the plating processes can be performed on the surface of the substrate 2 efficiently.

In the above-described plating apparatus 1, when performing a plating process with a high-temperature plating liquid, a temperature decrease of the plating liquid is prevented by rotating the substrate 2 at a low speed. However, it may be also possible to prevent the temperature decrease of the plating liquid by using a substrate temperature increasing device configured to increase the temperature of the substrate 2.

Figure 15:
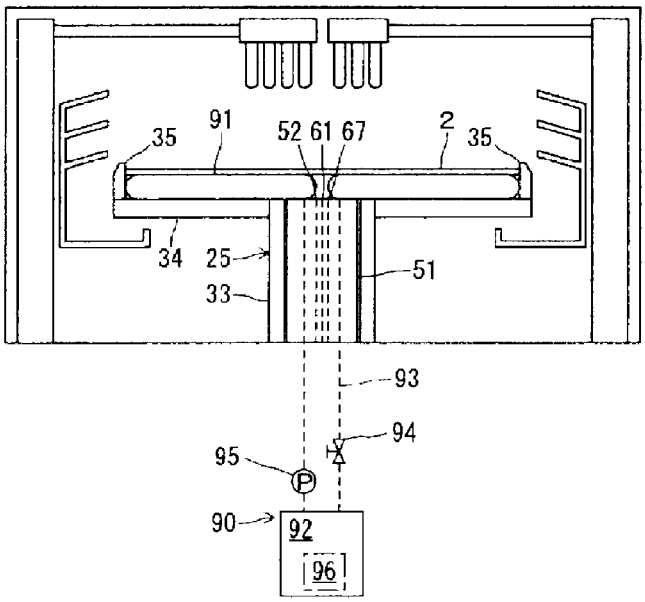
FIG. 15 is a side view illustrating a modification example of the plating apparatus in accordance with the illustrative embodiment.

By way of example, as illustrated in FIG. 15, a substrate temperature increasing device 90 includes a expandable/contractible heating body 91 that has a donut shape and is disposed on the turntable 34; a tank 92 storing therein heating fluid (heating fluid may be a liquid or a gas); and a circulation flow path 93 connected to the tank 92. A going path of the circulation flow path 93 is connected to the heating body 91 via an opening/closing valve 94, and a returning path of the circulation flow path 93 is connected to the heating body 91 via a suction pump 95. Further, a heater 96 is accommodated within the tank 92. The opening/closing valve 94, the suction pump 95 and the heater 96 are connected to and controlled by the controller 32. Furthermore, the nozzles 52, 61 and 67 are positioned at the central portion of the heating body 91 so that the discharge of the processing liquids from the nozzles 52, 61 and 67 may not be blocked by the heating body 91.

In the substrate temperature increasing device 90, the heating fluid stored in the tank 92 is heated by the heater 96 at a preset heating temperature, and by opening the opening/closing valve 94 and driving the suction pump 95, the heating fluid is supplied into the heating body 91. The heating body 91 is expanded by the supply pressure of the heating fluid and comes into contact (firm and close contact) with the bottom surface (rear surface) of the substrate 2. Then, the heating body 91 heats the substrate 2 from the bottom surface thereof, so that the temperature of the substrate 2 is increased. Further, in the substrate temperature increasing device 90, by closing the opening/closing valve 94 and driving the suction pump 95 for a preset period of time, the heating fluid is suctioned from the heating body 91. Accordingly, the heating body 91 is contracted by the suction pressure, so that a gap, through which the processing liquids supplied from the nozzles 52, 61 and 67 flow, is formed between the bottom surface of the substrate 2 and the turntable 34.

In this substrate temperature increasing device 90, by supplying the heating fluid into the donut-shaped heating body 91, the heating fluid can be prevented from being mixed with the various kinds of processing liquids.

Further, the substrate temperature increasing device 90 may be configured to change the heating temperature of the heating fluid depending on the kinds (temperatures) of the plating liquids.

In addition, as for the substrate temperature increasing device 90, the bottom surface of the substrate 2 may be divided into multiple regions, and different kinds of heating bodies may be provided at the respective regions. With this configuration, temperatures of the respective regions (e.g., an inner region and an outer region of the substrate 2) of the bottom surface of the substrate 2 can be increased independently. Accordingly, a temperature decrease of the plating liquids supplied to the substrate 2 can be suppressed more securely, and a plating temperature can be uniformed. As a result, it is possible to obtain a uniform plating thickness.

What is claimed is:

1. A plating method of performing plating processes by supplying plating liquids onto a surface of a substrate by using a plating apparatus, wherein the plating apparatus comprises:

a substrate rotating holder configured to hold and rotate the substrate;

a plurality of plating liquid supply units configured to supply different kinds of plating liquids onto the surface of the substrate held by the substrate rotating holder; and a plating liquid drain unit disposed in a vicinity of the substrate rotating holder and configured to separate the plating liquids dispersed from the substrate depending on the kinds of the plating liquids and drain out the separated plating liquids through drain openings of a cup included in the plating liquid drain unit, and wherein the plating method comprises:

performing a first plating process on the surface of the substrate by supplying a first plating liquid onto the surface of the substrate from one of the plating liquid supply units;

after performing the first plating process, collecting the first plating liquid which has been used through a first drain opening of the cup;

performing a second plating process on the surface of the substrate by supplying, from another one of the plating liquid supply units, a second plating liquid different from the first plating liquid supplied from the one plating liquid supply unit; and after performing the second plating process, collecting the second plating liquid which has been used through a second drain opening of the cup by vertically moving the cup, and wherein the substrate is continuously rotated during performing the first plating process and the second plating process.

* * * * *